US005081503A

United States Patent [19]

Parker et al.

[11] Patent Number: 5,081,503

[45] Date of Patent: Jan. 14, 1992

[54] COMPACT MAGNETIC BEAD PICK-OFF DEVICE

[75] Inventors: Delmer G. Parker, Rochester; William M. Allen, Webster, both of N.Y.

[73] Assignee: Xerox Corporation, Stamford, Conn.

[21] Appl. No.: 650,379

[22] Filed: Feb. 4, 1991

[51] Int. Cl.[5] ..... G03G 21/00

[52] U.S. Cl. ..... 355/296; 118/652; 355/269

[58] Field of Search ..... 118/652; 355/269, 270, 355/296, 297, 305

[56] References Cited

U.S. PATENT DOCUMENTS 4,647,186 3/1987 Armstrong et al. ..... 355/296

4,829,338 5/1989 Whittaker et al. ..... 118/652 X 4,969,015 11/1990 Sanpe ..... 355/297

*Primary Examiner*—A. T. Grimley

*Assistant Examiner*—R. J. Stanzione

[57] ABSTRACT

Carrier bead pick-off device including a magnet assembly and an enclosure in which the magnet assembly is reciprocated between a first position where carrier beads are picked off the photoreceptor and a second position where the carrier beads are caused to be returned to a developer housing structure. The enclosure in one embodiment of the invention forms part of the developer housing structure. The magnet is retracted such that it follows the contour of the enclosure so that the carrier beads are swept into the developer housing structure.

14 Claims, 3 Drawing Sheets

COMPACT MAGNETIC BEAD PICK-OFF DEVICE

BACKGROUND OF THE INVENTION

This invention relates to reproduction apparatus, and more particularly, to an electrophotographic device having a removal or pick-off device for removing carrier beads from the developer mix used to develop latent images which adhere to a charge retentive surface in the apparatus during development.

In electrophotographic applications such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways. Imaging systems using imagewise ion projection to a charge retentive surface to form an electrostatic latent image developable with toner operate similarly.

Developing material commonly used in systems for developing latent images on the charge retentive surface typically comprises a mixture of toner and a "carrier" of larger granular beads of a magnetic material. If the developing system is a magnetic brush assembly, magnetizable carrier beads also provide mechanical control for the formation of magnetic brush bristles so that toner can readily be brought into contact with the charge retentive surface. Toner is attracted to the latent image from the carrier beads to form the toner image.

It is not unusual for carrier beads to become highly charged in a development housing and adhere to the photoreceptor (p/r). This phenomenon, known as "Bead Carry-Out" (BCO) is a well known xerographic problem. BCO can create all sorts of undesirable effects. For example, beads that remain attached to an image area can cause transfer deletions that degrade copy quality. If, on the other hand, the carrier bead becomes detached during pre-transfer charging, it may fall into the corotron, or paper transport mechanism and lead to an electrical, or mechanical failure.

Normally, a carrier bead has the opposite charge polarity from it's companion toner and is repelled from the image area by the qE, where q is the toner charge and E is the electric field force. However, the qE force created by the cleaning field in the background regions will tend to move the charged carrier bead towards the photoreceptor. Fortunately, the qE force in the background regions is smaller compared to an image region. However, in unusual circumstances, the carrier bead can become charged to the same polarity as the toner. In this case, both the toner and the carrier are driven into the image area by the development field. This can happen when a carrier bead, heavily impacted with toner, becomes triboelectrically charged by other carrier; or a de-toned carrier bead, in momentary contact with a conductive part of the development housing, becomes inductively charged to the same polarity as the toner by the ambient electric fields within the housing.

It is more difficult for the development magnets, aided by gravity, to recapture a carrier bead once it loses its momentum, and becomes attached to the photoreceptor. The reason is the coulomb force between the carrier bead charge $q_c$ and the p/c charge $q_p$, which is proportional to $q_c q_p/r^2$, and the image force, which is proportional to $q_c^2/r^2$ both increase rapidly as the distance between the bead and p/r diminish. Small carrier beads (<70 microns diameter), and flat, plate-like carrier beads, are particularly prone to BCO because the bead's charge is proportional to its surface area ($\sim r^2$), while the forces that control the bead (magnetic, gravity, and inertial), are volume ($\sim r^3$) dependent.

BCO can be reduced by employing good developer housing design and operating practices that minimize the carrier impaction rate and that avoid conditions conducive to highly de-toned carrier beads. Even so, because of stress conditions, or stringent CQ requirements (where even an occasional BCO transfer deletion may not be acceptable), it is common practice to employ a bead pick-off magnet to retrieve maverick beads.

Typically, a BCO pick-off device relies on a permanent magnet assembly with a north/south pole pair in close proximity to the p/r to create a strong field that captures the bead and moves it towards the magnet assembly. If no means is provided to remove the captured beads, over a period of time they will accumulate and rake against the p/r. To avoid this, the pick-off magnet can be enclosed in a rotating, non-magnet sleeve. The purpose of the sleeve is to prevent the beads from coming into contact with the magnet (in which case the beads are hard to remove), and to convey the captured beads away from the bead pick-off region, where they are deposited in a catch tray, or returned to the development housing sump.

The conventional bead pick-off magnet assembly has proven to be a good countermeasure for the BCO problem. However, because of their mechanical and magnetic structure, these devices cannot be made much less than about one inch in diameter, and still be effective. Unfortunately, despite the need, size rules out the use of the conventional bead pick-off assembly for many applications. For example, it may not fit in small, compact machines or in color machines that employ multiple development housings that each require a separate pick-off magnet.

The BCO problem is particularly challenging in tri-level xerography, not only because of the multiple housing requirement, but because of unique demands placed on the first and second development housings. For example, the complimentary half of the tri-level latent image is present in the first development housing, and so the qE force driving normally charged carrier beads into the complimentary image is large in magnitude compared to that of the first image development field. Hence, even moderately charged carrier beads, although repelled by the first image areas, have a tendency to deposit themselves in the complimentary image areas. The problem in the second development housing is different. Here, the need to employ "soft" or low force (magnetic) development techniques to prevent damage to the first image, means there is little, or no magnetic force available to control BCO. Furthermore, the conductive carrier (CMB) employed in tri-level xerography to avoid fringe field development, is particularly prone to inductive charging. This is especially true in the first housing because of the high reverse fields created by the complimentary latent image.

Carrier bead removal devices are known, such as for example, U.S. Pat. No. 3,894,513 to Stanley et al. and U.S. Pat. No. 3,834,804 to Bhagat et al., which use a stationary magnet having a cylindrical shell rotating thereabout to remove the ferrous carrier beads from the photoreceptor for deposit in a sump or for return to the developer housing. Other bead pick-off devices are known, such as, for example, U.S. Pat. No. 4,210,397 to Macaluso et al. which suggests the use of an electromagnetic bead collector which is periodically activated for the collection of carrier beads on a non-magnetizable surface, and de-energized to release the beads along a return path to the developer housing. However, an electromagnetic bead collector is relatively expensive, costly to implement, and requires a rather large current source.

U.S. Pat. No. 4,190,351 to Macaluso et al. shows a bead removal arrangement in which the carrier beads are removed from the photoconductive surface by means of a movable magnet and a fixed non-magnetizable shield mounted in close association between said magnet and the photoconductive surface. During the copying cycle, the magnet is moved adjacent the fixed shield to cause magnetizable articles to be drawn against the shield from the photoconductive surface. After the copying cycle, the magnet is moved away from the fixed shield to withdraw the strong magnetic field from the shield, causing the magnetizable particles to fall from the shield into a collection tray by means of gravity.

U.S. Pat. No. 4,868,607 relates to a carrier bead pick-off device for removal of carrier beads adhering to a charge retentive surface in an electrophotographic device having at least one developer housing movable into and out of developing position. A magnet is supported on the movable developer housing of the type which is movable into and out of developing position with respect to the photoreceptor. When the developer housing is moved into developing position, the magnet is correspondingly brought into a position closely adjacent to a non-magnetic carrier bead catch supported closely adjacent to the charge retentive surface. Beads are collected at the bead catch and released upon removal of the magnet from proximity to the bead catch. The non-magnetic bead catch may be supported for movement into a bead catching position when the developer housing is brought into developing position, and to a bead releasing position when the developer is removed from developing position and the magnet is removed from its position adjacent the bead catch. When the bead catch is in bead catching position, the magnet is supported so that-captured beads are collected at the bead catch by the magnetic force. When the magnet is removed from that position, there is no longer a magnetic force attracting beads to the bead catch, and the movement of the bead catch to a bead release position allows collected beads to fall to a storage location.

Magnetic arrangements are known for the removal of magnetic material from a surface, including U.S. Pat. No. 4,552,451 to Yamazaki et al. and JP-A 59-94776 to Iwamasa.

It would be highly desirable to simply provide a magnetic member closely associated with the charge retentive surface for the removal of carrier beads therefrom, avoiding the need for moving parts or complex controls to operate a bead removal arrangement. However, it will no doubt be appreciated that over time, carrier beads would accumulate at such a magnetic member, and, unless removed, could cause damage or undesired abrasion of the charge retentive surface.

SUMMARY OF THE INVENTION

In accordance with the present invention there is provided an improved bead removal or pick-off device in an electrophotographic apparatus for removal of carrier beads from a charge retentive surface.

In accordance with one aspect of the invention, in an electrophotographic device having a plurality developer systems, a slender bar magnet having a rectangular cross section (xy), magnetized along its z axis, extends across the width of the p/r. The "x" dimension can be $\frac{1}{8}$ to $\frac{1}{4}$ inch and the "z" dimension, ~5 times the "x" dimension. A permanent magnet with this shape has an intense, localized field with a high gradient along it's edge. Such a magnet is ideally suited for attracting magnetic particles across a gap. A suitable material for the magnet is barium ferrite, oriented so that the preferred magnetization direction is along the "z" axis. Barium ferrite magnets have a permeability of ~1.1, and the flux will appear to emanate from poles at the physical ends of the bar magnet. The magnetic field may be further concentrated at one end of the magnet by the addition of a tapered, high permeability, pole piece. By concentrating the magnet's flux into a small localized area, and with a high field gradient, a strong impulse can be exerted on a carrier bead to dislodge it from the p/r. Put simply, the field induces a magnetic dipole moment into the carrier bead, and because of the field gradient, one pole is attracted with greater force than the other is repelled. The induced poles in a small, spherical carrier bead are very closely spaced, and so if the field magnitude does not change appreciably over the diameter of the bead, the net pull on the bead will be negligible.

Another benefit of the magnet shape described here is that, although the field is concentrated at its edges, the field along its sides is relatively uniform and weak. This allows the magnet to be placed in close proximity to the side of a developer housing without interfering with the normal flow of magnetic developer inside.

The magnet is enclosed in a fixed, conductive shroud to prevent captured carrier beads from coming into direct contact with the magnet and to allow the beads to be released when the magnet is retracted within its shroud and to discharge the beads. Because of the pick-off magnet assembly's small width, it can fit into the narrow spaces that cannot accommodate a conventional pick-off magnet. The narrow pick-off magnet can be retracted periodically to release captured beads to prevent the beads from forming bead chains that interfere with the p/r.

The bar pick-off magnet enclosure can be made part of the developer housing shroud to reduce the width of the pick-off assembly.

BRIEF DESCRIPTION OF THE DRAWINGS

These and other aspects and advantages of the invention will become apparent from the following description used to illustrate a preferred embodiment of the invention read in conjunction with the accompanying drawings in which.

THE PREFERRED EMBODIMENT OF THE INVENTION

Figure 1:
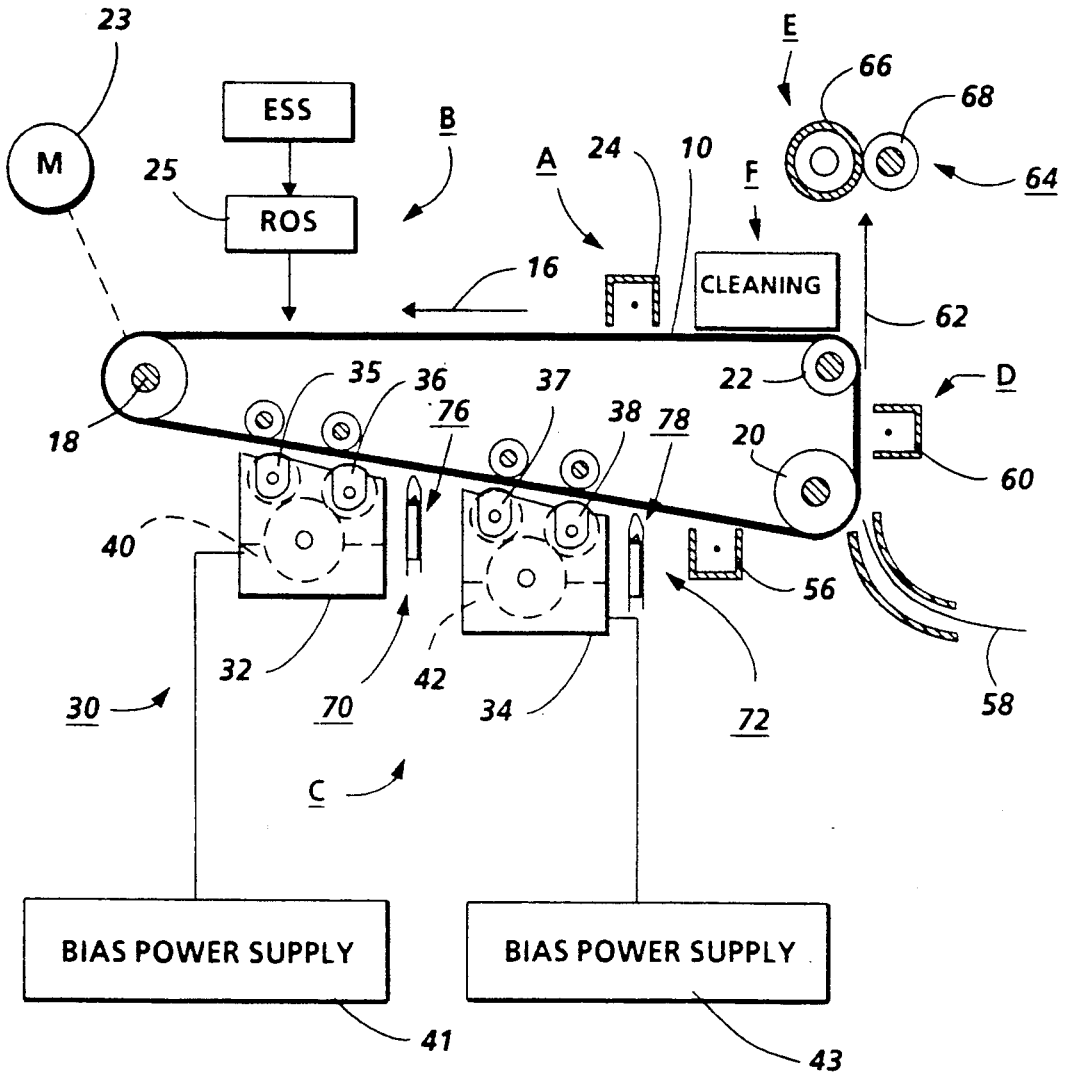
FIG. 1 is schematic illustration of a printing apparatus incorporating the inventive features of the invention.

Referring now to the drawings, where the showings are for the purpose of describing a preferred embodiment of the invention and not for limiting same, the various processing stations employed in the reproduction machine illustrated in FIG. 1 will be described only briefly.

A reproduction machine in which the present invention finds advantageous use utilizes a charge retentive member in the form of a photoconductive belt 10 consisting of a photoconductive surface and an electrically conductive, light transmissive substrate and mounted for movement past a charging station A, an exposure station B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as charged edges corresponding to portions of the photoreceptor outside the image areas.

The photoreceptor, which is initially charged to a voltage $V_0$, undergoes dark decay to a level $V_{ddp}$ equal to about 900 volts. When exposed at the exposure station B it is discharged to $V_c$ equal to about 100 volts which is near zero or ground potential in the highlight (i.e. color other than black) color parts of the image. The photoreceptor is also discharged to $V_w$ equal to 500 volts imagewise in the background (white) image areas. After passing through the exposure station, the photoreceptor contains charged areas and discharged areas which corresponding to two images and to charged edges outside of the image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40 by way of example contains negatively charged red toner. Electrical biasing is accomplished via power supply 41 electrically connected to developer apparatus 32. A DC bias of approximately −400 volts is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A suitable DC bias of approximately −600 volts is applied to the rollers 37 and 38 via the bias power supply 43.

Because the composite image developed on the photoreceptor consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer station D from a supply tray, not shown. Sheets are fed from the tray with sheet feeder, also not shown, and advanced to transfer station D. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, may be removed at cleaning station F with a magnetic brush cleaner 70.

Figure 2:
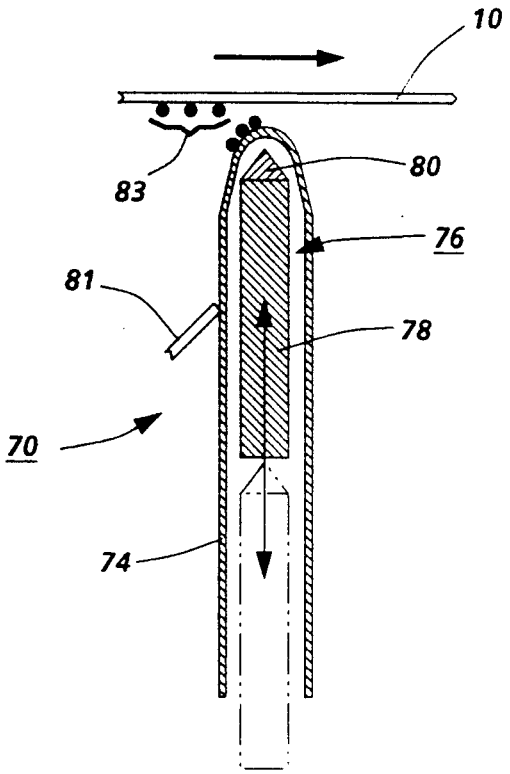
FIG. 2 is a schematic illustration of one embodiment of a bead pick-off assembly of the present invention.
Figure 3:
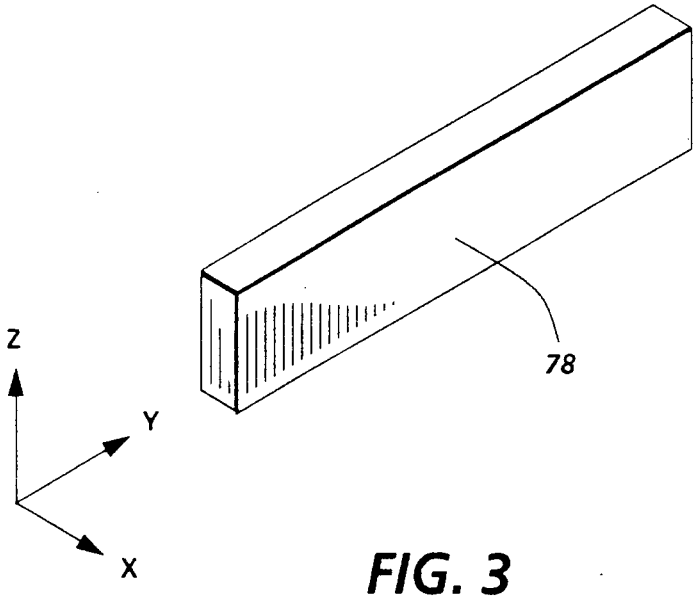
FIG. 3 is a perspective view of a bar magnetic forming a part of the assembly disclosed in FIG. 2.

In accordance with the invention, and with reference to FIGS. 1 and 2, the inventive bead pick-off devices 70 and 72 may comprise a conductive enclosure 74 and a magnet assembly 76. The magnet assemblies 76 and 78 are identical and each includes a bar magnet 78 and a pole piece 80. The magnet assembly is movable between the solid and dotted line positions by means of a mechanism to be discussed hereinafter. A bead deflector 81 for directing carrier beads 83 back into the developer housing structures 32 is positioned in contact with the conductive housing 74.

The bar magnets 78 have a rectangular cross section (xy), magnetized along its z axis, extends across the width of the photoreceptor. The "x" dimension can be $\frac{1}{8}$ to $\frac{1}{4}$ inch and the "z" dimension, ~5 times the "x" dimension. A permanent magnet with this shape has an intense, localized field with a-high gradient along its edge. Such a magnet is ideally suited for attracting magnetic particles across a gap. A suitable material for the magnet is barium ferrite, oriented so that the preferred magnetization direction is along the "z" axis. Barium ferrite magnets have a permeability of ~1.1, and the flux will appear to emanate from poles at the physical ends of the bar magnet. The magnetic field may be further concentrated at one end of the magnet by the addition of the tapered, high permeability, pole piece 80. By concentrating the magnet's flux into a small localized area, and with a high field gradient, a strong impulse can be exerted on a carrier bead to dislodge it from the p/r. Put simply, the field induces a magnetic dipole moment into the carrier bead, and because of the field gradient, one pole is attracted with greater force than the other is repelled. The induced poles in a small, spherical carrier bead are very closely spaced, and so if the field magnitude does not change appreciably over the diameter of the bead, the net pull on the bead will be negligible.

Figure 4:
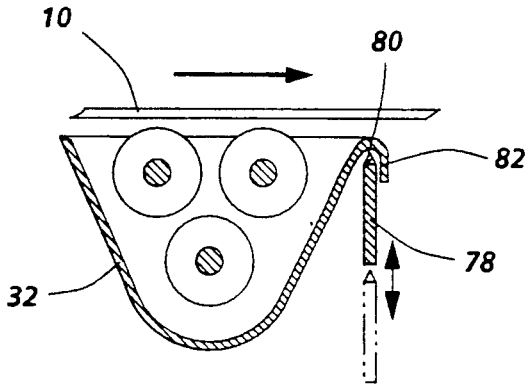
FIG. 4 is a schematic illustration of another embodiment of a bead pick-off assembly.

A modified bead pick-off device, as illustrated in FIG. 4, comprises an enclosure 82 which is integrally formed with the developer housing structure 32. The magnet assembly comprises a bar magnet 78 and a pole piece 80.

Figure 5:
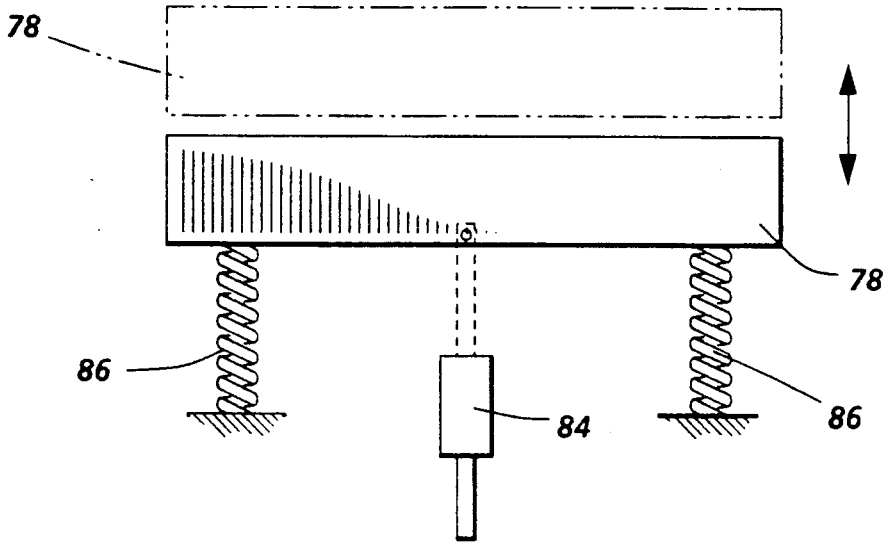
FIG. 5 is a schematic plan view of a magnet retracting mechanism.
Figure 6:
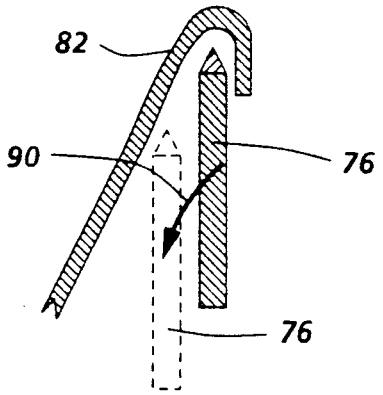
FIG. 6 is a schematic, side view illustration of the bead pick-off device of FIG. 4 depicting a magnet in a bead pick-off position and in a retracted position where it is inoperative to remove carrier beads from the photoreceptor.
Figure 7:
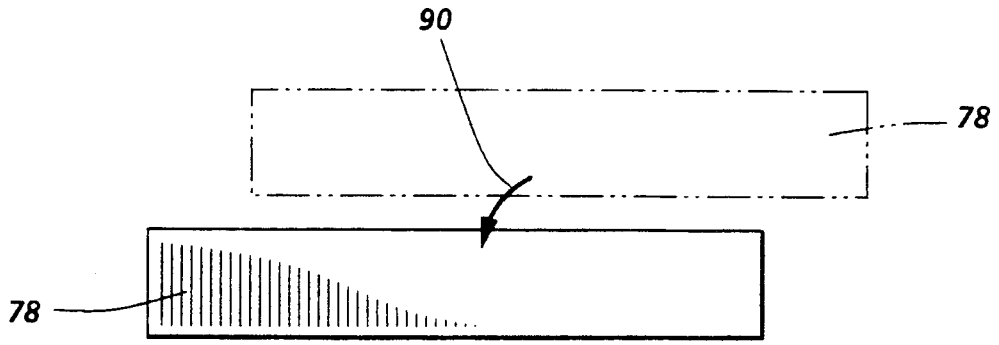
FIG. 7 is a schematic plan view of the bar magnet in its operative and retracted positions.

As disclosed in FIGS. 5 and 6, reciprocating movement of the magnet bar magnet 78 is effected using a solenoid device 84 and a pair of springs 86. As illustrated in FIGS. 6 and 7, the magnet assembly is moved relative to the enclosure 82 such that it follows the contour thereof so that the beads accumulated on the enclosure are efficiently swept from the area of the enclosure where they accumulate into the housing structure. The movement of the assembly follows the arrow 90.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

What is claimed is:

1. Reproduction apparatus including a charge retentive surface; an image forming station for forming a latent image on the charge retentive surface; at least one developer housing structure supporting developing means for developing the latent image with toner and carrier bead; a transfer station; and a carrier bead pick-off device for removing carrier beads adhering to the charge retentive surface after development, said carrier bead pick-off device comprising:

an enclosure supported such that a first portion thereof is disposed closely adjacent to said charge retentive surface;

a magnet assembly supported for reciprocating movement within said enclosure between a carrier bead pick-off position adjacent said first portion and a position adjacent a second portion of said enclosure whereby carrier beads are moved from said first to said second portion for effecting return of carrier beads to said developer housing structure, said magnet assembly having a strong carrier bead attraction field concentrated at an end thereof which is closest to said first portion and a relatively uniform and weak field in a part thereof closely disposed adjacent said developer housing structure; and means for effecting periodic reciprocating movement of said magnet assembly.

2. Apparatus according to claim 1, wherein said enclosure is fabricated from electrically conductive material.

3. Apparatus according to claim 2 wherein said enclosure comprises part of said developer housing structure.

4. Apparatus according to claim 3 wherein said one end comprises a pole piece and said part of said magnet assembly having a relatively uniform and weak field comprises a bar magnet.

5. Apparatus according to claim 4 wherein said means for effecting movement of said magnet assembly comprises a solenoid and spring arrangement.

6. Apparatus according to claim 5 wherein said magnet assembly is supported for movement such that said pole piece follows the contour of said enclosure whereby carrier beads are swept along the surface of said enclosure from said first portion to said second portion.

7. Apparatus according to claim 6, wherein said reproduction apparatus comprises a plurality of developer housing structures and a carrier bead pick-off device for each of said structures.

8. The method of removing carrier beads from a charge retentive surface, said method including the steps of:

supporting an enclosure such that a first portion thereof is disposed closely adjacent to a charge retentive surface;

supporting a magnet assembly for reciprocating movement within said enclosure between a carrier bead pick-off position adjacent said first portion and a position adjacent a second portion of said enclosure whereby carrier beads are moved from said said first to said second portion for effecting return of carrier beads to said developer housing structure, said magnet assembly having a strong carrier bead attraction field concentrated at an end thereof which is closest to said first portion and a relatively uniform and weak field in a part thereof closely disposed adjacent said developer housing structure; and effecting periodic reciprocating movement of said magnet assembly.

9. The method according to claim 8 wherein said enclosure is fabricated from electrically conductive material.

10. The method according to claim 9 wherein said enclosure comprises part of said developer housing structure.

11. The method according to claim 10 wherein said one end comprises a pole piece and said part of said magnet assembly having a relatively uniform and weak field comprises a bar magnet.

12. The method according to claim 11 wherein said means for effecting movement of said magnet assembly comprises a solenoid and spring arrangement.

13. The method according to claim 12 wherein said magnet assembly is supported for movement such that said pole piece follows the contour of said enclosure whereby carrier beads are swept along the surface of said enclosure from said first portion to said second portion.

14. The method according to claim 13 including the step of providing a plurality of enclosures and magnet assemblies, one for each developer housing structure utilized.

* * * * *